United States Patent [19]

Carter

[11] Patent Number: 4,498,201

[45] Date of Patent: Feb. 12, 1985

[54] TROUSER SUPPORT SYSTEM

[76] Inventor: R. S. Carter, 3416 Purdue, Dallas, Tex. 75225

[21] Appl. No.: 414,300

[22] Filed: Sep. 2, 1982

[51] Int. Cl.[3] ..... A41F 9/00

[52] U.S. Cl. ..... 2/312; 2/311; 2/316; 2/220

[58] Field of Search ..... 2/312, 311, 316, 302, 2/308, 220; 128/531, 579 R

[56] References Cited

U.S. PATENT DOCUMENTS

| | | | |
|---|---|---|---|
| 709,823 | 9/1902 | Mehlfeld | 2/312 |
| 809,074 | 1/1906 | Niles . | |
| 1,039,995 | 10/1912 | Niles | 2/302 |
| 1,206,070 | 11/1916 | Wohlgemuth . | |
| 1,225,947 | 5/1917 | Fleming | 2/302 |
| 1,297,158 | 3/1919 | Hawkins | 2/302 |
| 1,830,302 | 11/1931 | Townsend . | |
| 2,505,383 | 4/1950 | Brunson | 2/302 |

FOREIGN PATENT DOCUMENTS

| | | | |
|---|---|---|---|
| 441495 | 3/1927 | Fed. Rep. of Germany | 2/302 |
| 137420 | 12/1933 | Fed. Rep. of Germany | 128/579 |
| 572233 | 2/1924 | France | 2/302 |

*Primary Examiner*—Werner H. Schroeder
*Assistant Examiner*—Mary A. Ellis
*Attorney, Agent, or Firm*—Warren H. Kintzinger

[57] ABSTRACT

A belt for supporting trousers has a lower adjustable supporting strap. Stiff members are attached to the waistband of the trousers. Supporting arms are rotatably coupled to the stiffened members and the supporting strap. When the trousers are worn, the weight is partially supported in the small of the wearer's back and partially on the wearer's hips by force transmitted through the support members.

7 Claims, 2 Drawing Figures

TROUSER SUPPORT SYSTEM

BACKGROUND AND SUMMARY OF THE INVENTION

The present invention relates generally to supporting devices for garments and more specifically to a supporting device for trousers which transfers the weight of the trousers to the small of the back and the hips of the wearer.

The cut of many trousers, for both males and females, results in a waistband which is positioned approximately at the waist of the wearer, i.e., above the wearer's hips. Whether or not a belt is worn, the full weight of the trousers must be supported from the waistband. The waistband must be tightened against the stomach sufficiently to support the trousers, or the trousers will have a tendency to slip down so that the waistband rests on the wearer's hips. These trousers often have an unfashionable look if they are worn other than where intended, and can be unsightly and uncomfortable when a belt is tightly cinched around the waist.

Both problems are especially acute for many overweight persons, especially those with protruding stomachs. In order to support the trousers in approximately the desired position, the waistband must be belted quite tightly, or the front portion of the trousers raised to where they will rest on the upper side of the stomach bulge. Otherwise, the waistband of the trousers tends to slip down in front to a position generally below the stomach bulge. This results in the trousers hanging improperly throughout their length, with the waistband being lower in front than in back.

Attempts have been made to overcome this problem in the past. Perhaps the best known example is the development of suspenders, which transfer the weight of the trousers to the shoulders while holding the waistband relatively level. The use of suspenders has a number of obvious drawbacks, including the fact that the suspenders are visible unless covered by a coat or other garment. Further drawbacks include the fact that the elastic material which generally must be used for suspenders can stretch or can be pulled out of shape, and the trousers may "ride up" in back when the wearer bends over. Additionally, many people are uncomfortable with the fact that the weight is being supported from the shoulders rather than at the waist/hip region of the body.

Various attempts have been made to provide a supporting device in which the weight of the trousers is supported on the hips while the waistband remains at the wearer's waist level. These attempts have included, for example, the use of long flexible rods which wrap around the wearer's hips and attach to the waistband at various points. Other attempted solutions to this problem include the use of a lower belt worn around the hips. Such an apparatus employs a plurality of stiff vertical members coupled to a second belt, which is in turn attached to the waistband of the trousers.

The solutions proposed by the prior art have several important drawbacks. Such previous solutions are difficult to adjust to various sizes. Devices presently known in the art are difficult and cumbersome to use, and are complicated in construction. This complexity deters the use of such devices, and makes them expensive to produce. Present devices are generally uncomfortable to wear, and some have relatively large mechanical parts which show through the trousers.

It is therefore an object of the present invention to provide a trouser support device which causes the weight of the trousers to rest partially on the wearer's hips and partially in the small of the back. It is a further object that such a trouser support device be simple to put on, comfortable to wear and inexpensive to manufacture. It is another object that such a support device not be visible when used.

In order to obtain these and other objects, a device constructed in accordance with the present invention has a flexible belt which is suitable for wearing about a person's hips. Two stiff support arms are pivotally coupled to either side of such belt, and are also pivotally coupled respectively a plastic strip on each side enclosed within to the waistband of the trousers. The weight of the trousers is transferred in part through the support arms and support belt to the hips of the wearer, and in part to the small of the wearer's back through the waistband of the trousers.

The novel features which characterize the present invention are defined by the appended claims. The foregoing and other objects and advantages of the invention will hereinafter appear, and for purposes of illustration but not of limitation, a preferred embodiment is shown in the accompanying drawings.

DESCRIPTION OF THE PREFERRED EMBODIMENT

Figure 1:
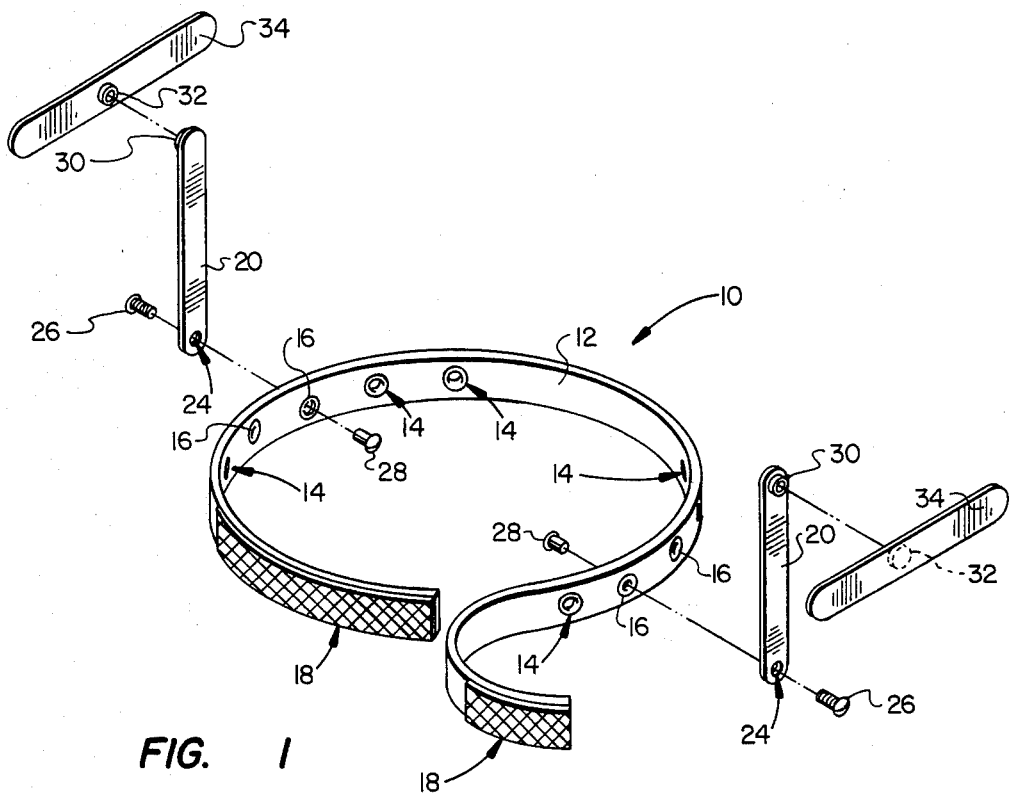
FIG. 1 is an exploded view of trouser support device constructed according to the present invention.

The preferred embodiment of a device 10 constructed according to the present invention is shown in FIG. 1. A flexible belt 12, preferably made of leather or a similar material, has a plurality of, and preferably five (5) holes 14 on either side. These holes 14 are spaced about two inches apart, and preferably have metal reinforcing rings 16 inserted therein to prevent excessive wear of the belt 12 material. The belt 12 may be fastened in front by any means, but is preferably fastened by a nylon hook and eye fastener 18. An example of such a fastener 18 is the product Velcro, a nylon hook and eye fasterner, which allows the belt 12 to be quickly and easily fastened and unfastened but will stay firmly in place when desired.

Two support arms 20 are made of material which is stiff enough not to flex or bend appreciably from the weight of trousers 22, such as a stiffened plastic. These support arms 20 each have a hole 24 in the lower end, into which a bolt 26 can be inserted. For more adjustability, the support arms 20 may have a plurality of spaced holes 24 at various positions in their lengths. Each bolt 26 is fastened on the inside of the belt 12 by a nut 28, preferably of a type having a capped end and an internally threaded sleeve as shown. This sleeve projects through the belt hole 14 and support arm hole 24, and acts as an axle about which the support arm 20 can rotate.

A male engaging member 30 of a conventional snap fastener is attached to the upper end of each support arm 20. The female portions 32 of the snap fasteners are attached to the middle of waistband stiffeners 34. These waistband stiffeners 34 are attached to the waistband 36 of the trousers 22. These stiffeners 34 may be attached to the trousers 22 by any conventional means, such as insertion into slots in the waistband 36, or being relatively permanently affixed thereto such as by being sewn into the waistband 36. The prop fasteners provide for rotatably coupling the support arms 20 to the stiffeners 34 that are made of material stiff enough not to flex or bend appreciably from the weight of trousers 22, such as a stiffened plastic, and as such the stiffeners keep waistband the waistband 36 from peaking at the points of attachment. These waistband stiffeners 34 eliminate modifying (other than by opposite side three quarter inch vertical access slits inside of the waistband) the trousers to be supported and insures maintainance of a straight waistband line.

Figure 2:
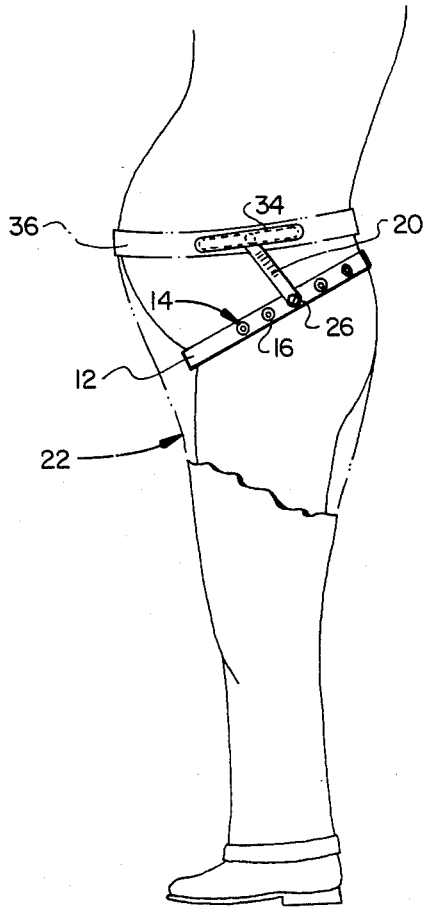
FIG. 2 is a partially cutaway view of the device of FIG. 1 when assembled and worn with a pair of trousers.

As shown more clearly in FIG. 2, the embodiment of FIG. 1 is used by strapping the belt 12 in place about the wearer's hips. The belt 12 is preferably located so that the front portion is below the stomach, and the middle portion rests slightly above the hips. The support arms 20 are positioned at the holes 14 desired by the wearer, but should preferably be selected at positions concentric with the hip joints of the wearer so as to provide greater mobility in bending, sitting and stooping. As will be described below, positioning the support arm 20 at a hole toward the front causes a greater portion of the weight of the trousers 22 to rest on the wearer's hips, while positioning such arms 20 toward the rear causes a greater portion of the weight of the trousers 22 to be borne at the small of the back. The waistband stiffeners 34, having been attached to the trousers 22, are snapped in place against the support arms 20.

Each support arm 20 is pivotally coupled at both ends, so that all weight borne by the support arm 20 is directly along its length. If the lower end of the support arm 20 is positioned more forwardly than the position shown in FIG. 2, it will be essentially vertical and virtually the entire weight of the trousers 22 will be transferred through the support arm 20 and the support belt 12 to the hips. When the lower end of the support arm 20 is preferably positioned as shown in FIG. 2, the weight of the trousers 22 is not supported vertically by the support arm 20, and there exists a moment about the lower axle of the support arm 20 in a forward direction (counterclockwise as shown in FIG. 2). A portion of the weight of the trousers 22 is transferred to the hips in a rearward direction through the support arm 20 and belt 12, while the remainder of the weight is transferred through the waistband and presses against the small of the back in a horizontal direction. Locating the lower end of the support arm 20 further to the rear results in a greater proportion of the trouser weight being suspended from the small of the back.

Positioning the support arms 20 approximately as shown in FIG. 2 is preferred, as experience has shown that such position results in a very comfortable distribution of weight and a good "hang" to the trousers 12. Of course, the plurality of holes 14 in the belt 12 allows the support arm 20 to be positioned to each wearer's personal taste, and in addition allows a relatively small number of standard sized devices 10 to fit persons of various sizes. As will be noted from the above description, the support device 10 is extremely simple and inexpensive to manufacture, as well as being simple to use and non-cumbersome. A single belt 12 can be used for all of a person's trousers, with snap fasteners 32 being permanently affixed to waistband stiffeners 34 within the inside of all trouser waistbands, or other mounting means can be temporairly or permanently attached to the inside of the waistband so that upper pivot connection of each support arm 20 is approximately two inches forward of the side seam of the trousers on each side of the trousers. The stiffeners 34, support arms 20, and bolts 26 and nuts 28 are identical on the left and right sides, and are easily obtained materials so that productions costs for the support device 10 are extremely low. The plasticstiffners 34 are inserted into each side of the waistband through a vertical slit approximately three quarters of an inch long approximately two inches in front of the side seam on each side of the trousers so that with the snap fastener 32 pivotal snapped engagement with male engagement member 30 through the vertical slit in the waistband on each side. This locates the pivot connection at the top of the support arms 20 forward of the pivot connection at the bottom of the support arms 20 as related to the user's body when the pivot axis at the bottom is positioned with pivot hole 14 properly in alignment substantially concentric with the transverse axis of the wearer's hip joints. Thus the advantageous "Z" like configuration is attained as shown in FIG. 2.

Because a device constructed as described above has minimal projection in a radial direction, the support device 10 does not show when worn. The belt 12, support arms 20 and stiffeners 34 all press closely to the wearer's body. Thus, the appearance of the trousers is greatly improved because they are worn as the designer intended, with no obvious extra support.

Although a preferred embodiment has been described in detail, it should be understood that various substitutions, alterations, and modifications may become apparent to those skilled in the art. These changes may be made without departing from the spirit and scope of the invention as defined by the appended claims.

What is claimed is:

1. A support device for trousers comprising: a flexible supporting belt having adjustable length fastening means for fastening the belt around the hip region of the user; duplicate support arms pivotally mounted on opposite sides of said flexible supporting belt; pivotal interconnect mounting means interconnecting each of said duplicate support arms to said flexible supporting belt; duplicate trouser waistband stiffeners pivotally mounted on said duplicate support arms at the ends thereof remote from the pivotal mounting of said flexible supporting belt; and connection means connecting said trouser waistband stiffeners to opposite sides of a trouser waistband.

2. The support device for trousers of claim 1, wherein said connection means connecting said trouser waistband stiffeners to opposite sides of a trouser waistband includes pivot means interconnecting said duplicate support arms to said trouser waistband stiffeners.

3. The support device for trousers of claim 2, wherein said connection means is a snap fastener interconnecting each of said duplicate support arms to said trouser waistband stiffeners.

4. The support device for trousers of claim 3, wherein said trouser waistband stiffeners and said snap fastener interconnect are so located that the upper pivot connection of said duplicate trouser waistband stiffeners on said duplicate support arms is forward from the pivot mounting means interconnect of each of said duplicate support arms with opposite sides of said flexible supporting belt when the pivotal mounting interconnect between said duplicate support arms and said flexible support belt is substantially in concentric alignment with the transverse axis of a wearer's hip joint.

5. The support device for trousers of claim 4, wherein said flexible supporting belt is provided with a plurality of relatively closely spaced holes on both sides of said belt as related to user's body; pivotal interconnect mounting means pivotally mounting said duplicate support arms on said flexible supporting belt selectively mountable in a hole of relatively closely spaced holes on both sides of said belt to locate the pivot mounting of said duplicate support arms on said belt optimally in substantial concentric alignment with the transverse axis of a wearer's hip joint.

6. The support device for trousers of claim 5, wherein said pivot interconnect mounting means is a pivotal bolt and nut structure with the nut a capped end and internally threaded sleeve nut.

7. The support device for trousers of claim 5, wherein each of said plurality of relatively closely spaced holes on both sides of said belt includes a metal eyelet reinforcing ring to facilitate pivoting of said pivot interconnect mounting means and minimize wear of said belt.

* * * * *